US009932773B2

(12) United States Patent
Pikowski

(10) Patent No.: US 9,932,773 B2
(45) Date of Patent: Apr. 3, 2018

(54) DRIVE DEVICE AND METHOD FOR OPERATING A DRIVE DEVICE

(71) Applicant: EURODRILL GmbH, Drolshagen (DE)

(72) Inventor: Andreas Pikowski, Drolshagen (DE)

(73) Assignee: EURODRILL GmbH, Drolshagen (DE)

( * ) Notice: Subject to any disclaimer, the term of this patent is extended or adjusted under 35 U.S.C. 154(b) by 1029 days.

(21) Appl. No.: 14/190,898

(22) Filed: Feb. 26, 2014

(65) Prior Publication Data

US 2014/0238712 A1 Aug. 28, 2014

(30) Foreign Application Priority Data

Feb. 27, 2013 (EP) ..... 13157000

(51) Int. Cl.
*B23D 45/16* (2006.01)
*E21B 7/00* (2006.01)
*E21B 6/02* (2006.01)

(52) U.S. Cl.
CPC ..... *E21B 7/002* (2013.01); *E21B 6/02* (2013.01)

(58) Field of Classification Search
CPC ..... E21B 6/00
USPC ..... 173/1, 90, 105
See application file for complete search history.

(56) References Cited

U.S. PATENT DOCUMENTS 3,835,943 A 9/1974 Bray
4,253,531 A 3/1981 Boros
5,064,002 A 11/1991 Patterson
5,417,290 A * 5/1995 Barrow ..... E21B 25/02 175/22
8,002,684 B2 * 8/2011 Laurent ..... A61H 1/005 482/142

FOREIGN PATENT DOCUMENTS

EP 0 057 089 A1 8/1982
EP 2 444 587 A1 4/2012
WO 2009/014444 A1 1/2009
WO WO 2012155305 A1 * 11/2012 ..... E21B 1/02

OTHER PUBLICATIONS

Translation of WO2012155305A, Jan. 8th 2017.*
The European search report dated Jul. 2, 2013, which corresponds to European Patent Application No. 13157000 and is related to U.S. Appl. No. 14/190,898.

* cited by examiner

*Primary Examiner* — Robert Long
*Assistant Examiner* — Eyamindae Jallow
(74) *Attorney, Agent, or Firm* — Studebaker & Brackett PC

(57) ABSTRACT

The invention relates to a drive device for driving a drill rod having a drive means with a rotary drive and a vibration drive for driving an output shaft in a rotating and axially vibrating manner and an adapter means which is coupled with the output shaft and comprises an outer adapter for connecting an outer rod and an inner adapter for connecting an inner rod. The outer adapter is adapted to transmit the rotational movement and the axially vibrating movement of the output shaft to the outer rod. The inner adapter is supported in an axially displaceable and spring-mounted manner in the outer adapter. The invention further relates to a method for operating a drive device.

13 Claims, 1 Drawing Sheet

DRIVE DEVICE AND METHOD FOR OPERATING A DRIVE DEVICE

BACKGROUND OF THE INVENTION

Field of the Invention

The invention relates to a drive device for driving a drill rod in accordance with the preamble of claim 1 and to a method for operating a drive device.

The drive device comprises a drive means with a rotary drive and a vibration drive for driving an output shaft in a rotating and axially vibrating manner and an adapter means which is coupled with the output shaft and comprises an outer adapter for connecting an outer rod and an inner adapter for connecting an inner rod.

Description of Related Art

A drive device of the stated type is disclosed, for example, in EP 2 444 587 A1. In this known drive device an output shaft is set into rotation by means of a rotary drive and a vibration of the output shaft is generated by means of a vibration drive. On the side of the output shaft facing towards the drill rod an adapter is provided, to which both an inner rod and an outer rod can be connected. In this case, the rotational movement and the vibration are transmitted to the same extent to the inner rod and the outer rod.

BRIEF SUMMARY OF THE INVENTION

In order to exclusively drive the outer rod in a vibrating manner and to solely provide a rotational movement on the inner rod, provision can be made in the known drive device for a second rotary drive with an independent output shaft, to which the inner rod can be connected. In this way, inner rod and outer rod can be driven independently of each other.

Through the provision of two independent rotary drives the known solution for providing an exclusively rotating drive of the inner rod proves to be laborious.

The invention is based on the object to provide a drive device and a method for operating a drive device which enable a particularly economical production of a borehole.

In accordance with the invention the object is achieved by a drive device having the features of claim 1 and by a method having the features of claim 12. Preferred embodiments of the invention are stated in the dependent claims.

Concerning the drive device provision is made in accordance with the invention in that the outer adapter is adapted to transmit the rotational movement and the axially vibrating movement of the output shaft to the outer rod and in that the inner adapter is supported in an axially displaceable and spring-mounted manner in the outer adapter.

Concerning the method according to the invention a rotating and axially vibrating movement is transmitted by means of a drive means to an output shaft, the rotating and axially vibrating movement of the output shaft is transmitted to an outer adapter, which is coupled with an outer rod, and the rotational movement of the outer adapter and/or the output shaft is transmitted to an inner adapter which is coupled with an inner rod. The inner adapter is supported in an axially displaceable and spring-mounted manner in the outer adapter.

A first fundamental idea of the invention can be seen in the fact that the outer adapter is coupled with the output shaft in such a way that the rotational movement and the vibration of the output shaft are transmitted to the outer adapter and from there to the outer rod. Hence, for the transmission of rotations and axial movements the outer adapter is firmly connected to the output shaft.

A second fundamental idea of the invention can be seen in the fact that the inner adapter is supported in an axially movable manner relative to the outer adapter or output shaft so that the axially vibrating movement of the output shaft is not transmitted, or at least to a reduced degree, to the inner rod. The inner adapter is movable by a defined amount in the axial direction of the drill rod, in which case the movement of the inner adapter relative to the outer adapter is preferably limited. By preference, the inner adapter is supported inside the outer adapter in a manner coaxial thereto.

By way of the drive device according to the invention it is possible to transmit a vibration to an outer rod, while the transmission of the vibration to the inner rod is at least reduced by the inner adapter which is supported in an axially displaceable manner. Hence, the axial movement of the inner adapter and thus of the inner rod is largely decoupled from the axial movement of the outer adapter or outer rod. Accordingly, the adapter means can also be referred to as a decoupling means.

The drive means is adapted to transmit a vibrating movement of an output shaft in an unchanged manner to an outer rod, while the transmission to an inner rod supported inside the outer rod is reduced or attenuated. In the extreme case, the decoupling of outer rod and inner rod with regard to the transmission of a vibration can be designed such that no vibrations are generated on the inner rod.

The rotational movement of the output shaft, however, is transmitted to both the outer rod and the inner rod. For the transmission of the rotational movement to the inner rod a drive toothing, is preferably provided. A drive toothing distinguishes itself, in particular, by the ability of axial displacement of the mutually engaging tooth flanks. Hence, given an axial movability of the inner adapter, a rotational movement can be transmitted to the inner adapter. Outer rod and inner rod preferably rotate at the same angular speed.

The transmission of the rotational movement to the inner adapter preferably takes place via the outer adapter. In order to transmit the rotational movement of the outer adapter to the inner adapter, it is preferred in accordance with the invention that the inner adapter is coupled via a drive toothing with the outer adapter. Alternatively or additionally, the rotational movement of the output shaft can also be transmitted directly, for instance via a drive toothing, from the output shaft to the inner adapter. The provision of a drive toothing with tooth flanks that are axially movable with respect to each other allows for a secure transmission of a rotational movement along with a simultaneous axial movability of the elements coupled rotationally with each other.

According to the invention it is preferred that for the spring-mounted support of the inner adapter in the outer adapter a spring means having at least one spring element is provided, which is designed as a preload spring and/or as a pneumatic spring unit.

In a preferred embodiment the spring means has at least two mutually counteracting spring elements, such as compression and/or tension springs. The counteracting, separate spring elements effectively cushion the opposed axial movements of the inner adapter. The axial movement of the inner adapter in the outer adapter is therefore cushioned in both directions, in which case the respective spring characteristics can be set separately by the independent spring elements.

By preference, between the spring elements an axial guide for axially guiding the inner adapter along the outer adapter is provided. The axial guide, which can be constituted, in particular, by the drive toothing and is therefore designed, as it were, for the transmission of the torque, ensures a reliable coaxial guidance of the inner adapter in the outer adapter.

The vibration on the output shaft can be generated in a particularly economical way in that the vibration drive comprises rotating masses. The rotating masses each comprise an eccentric weight and are set into a synchronized rotational movement so that the proportions of imbalance acting radially to the longitudinal axis offset each other. The axially acting vibrating movements are transmitted via a suitable transmission means, such as an axial or thrust bearing, to the output shaft. By preference, the output shaft is supported in a rotatable manner with respect to the vibration drive.

To transmit the rotational movement to the output shaft the rotary drive preferably comprises a main or drive shaft which can be driven in a rotating manner and is preferably coupled via a drive toothing with the output shaft. By preference, the output shaft is supported in an axially movable manner with respect to the drive shaft of the rotary drive. The output shaft is preferably guided through the drive shaft designed as a hollow shaft and is rotationally coupled with the latter via the drive toothing. The main shaft can be driven, for example, by way of a drive pinion driven by a rotation motor.

A compact and shielded drive device can be provided in that the rotary drive and the vibration drive are accommodated in a common housing. By preference, the vibration drive is supported in an axially movable manner in the housing.

The rotary drive is preferably arranged on the side of the vibration drive facing towards the adapter means. In this way, there is no need for the output shaft to be guided through the vibration drive.

For the coupling with the output shaft the adapter means preferably comprises a flange and/or a thread. By preference, the adapter means is releasably fixed by means of fixing elements on the output shaft. The output shaft preferably also comprises a flange and/or a thread. In a preferred embodiment the output shaft is provided with a connecting flange arranged in a ring-shaped manner around the outer circumference of the output shaft. The adapter means preferably comprises a corresponding flange section.

In order to provide on the inner rod a vibrating or percussive movement that is independent of the vibration drive it is preferred that at its end lying opposite the adapter means the inner rod is coupled with a percussion drive for generating a percussive movement of a drilling tool. The preferably hydraulically operated percussion drive can generate independently of the vibration drive an axially reversing movement of the drilling tool driven in a rotating manner by the inner rod. In this way, depending on soil conditions, the drilling progress can be increased considerably. The percussion drive can have an axially upward and downward movable hammer.

On the outer rod driven in a rotating and vibrating manner a ring-shaped drilling tool is preferably fixed, which can also be referred to as an annular drill bit.

The percussion drive, which can in particular be a so-called down-the-hole hammer, is especially designed to predrill the borehole through a percussive and simultaneous rotating movement. The rotational movement is provided by the rotary drive arranged outside the borehole, while the percussive movement is generated by the percussion drive located in the borehole. By preference, the percussion drive is arranged in the immediate vicinity of the inner drill bit, i.e. between inner rod and inner drill bit. The percussive forces are transmitted directly to the inner drilling tool and not via the inner rod. To this end, the inner drill bit, i.e. the drilling tool of the inner rod, suitably projects axially with respect to the drill bit of the outer rod.

A reliable transmission of the torque along with a simultaneous axial relative movement can be realized in the method according to the invention in that the rotational movement of the outer adapter is transmitted via a drive toothing to the inner adapter.

The device according to the invention and the method according to the invention offer, inter alia, the following advantages:

The vibratory power is led almost without restriction exclusively into the outer rod, the inner rod is axially decoupled.

With the inner rod a down-the-hole hammer can be operated for example. This permits so-called overburden drilling, in which pre-drilling is effected using the down-the-hole hammer and the predrilled borehole is enlarged by a drilling tool coupled with the outer rod.

To introduce a flushing liquid into the borehole the device can be equipped with an introduction means. The flushing can be introduced for example from the rear through the vibration drive or the vibration unit or also via a lateral flush head located in front of the rotary drive.

BRIEF DESCRIPTION OF THE SEVERAL VIEWS OF THE DRAWINGS

In the following the invention is described further by way of a preferred embodiment shown schematically in the accompanying Figures, wherein shows.

DETAILED DESCRIPTION OF THE INVENTION

Figure 1:
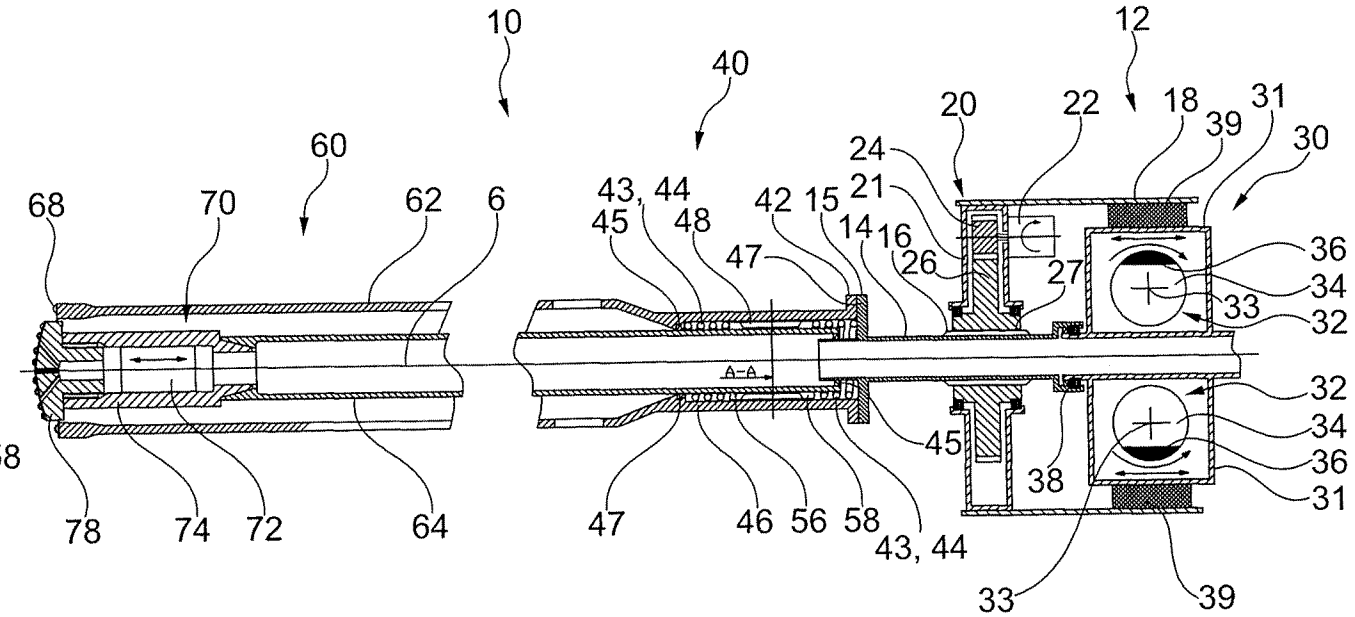
FIG. 1: a longitudinal section of a drive device according to the invention with a double rod connected thereto
Figure 2:
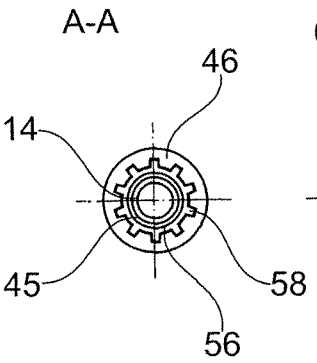
FIG. 2: a cross-sectional view along the line A-A of FIG. 1.

A drive device 10 according to the invention comprises a drive means 12, which can also be referred to as a vibration rotary drive, as well as an adapter means 40 for accommodating a drill rod 60 designed as a double rod. The drill rod 60 comprises an outer rod 62 and an inner rod 64.

The drive means 12 comprises a rotary drive 20 for driving an output shaft 14 in a rotating manner and a vibration unit or a vibration drive 30 for generating a vibration on the output shaft 14.

The rotary drive 20 comprises a motor 22 that drives a drive pinion 24 in a rotating manner which is engaged with a main shaft 26 designed as a hollow shaft and drives the latter in a rotating manner. The main shaft 26 is supported in a housing 21 of the rotary drive 20. Via a drive toothing 16, 27 the torque is transmitted to the output shaft 14. The output shaft 14 is guided axially through the main shaft 26 and comprises an outer toothing 16 that meshes with an inner toothing 27 of the main shaft 26. The drive toothing 16, 27 allows for an axial displacement of the output shaft 14 in the rotary drive 20.

The vibration drive 30 comprises a vibration housing 31, in which rotating shafts 34 are supported in a rotating manner about axes of rotation 33. On the shafts 34 eccentrics 36 are provided. The shafts 34 with the eccentrics 36 jointly form rotating masses 32. The vibration drive 30 or the vibration housing 31 is coupled via a bearing 38 with the output shaft 14 and transmits an axial up-and-down movement to the output shaft 14.

The vibration drive 30 together with its vibration housing 31 and the rotary drive 20 are accommodated in a common housing 18, the vibration drive 30 being supported in an axially movable manner in the housing 18 by way of elastic elements 39.

At the end of the output shaft 14 facing towards the drill rod 60 a decoupling piece or rather an adapter means 40 is arranged, to which the outer rod 62 and the inner rod 64 can be connected at the same time. To connect the adapter means 40 to the output shaft 14 the said output shaft 14 comprises a flange 15, to which the adapter means 40 can be connected. For this purpose, the adapter means 40 comprises a corresponding connection flange 42.

Firmly connected to the connection flange 42 is an outer adapter 46, to which the outer rod 62 can be connected. In the tubular outer adapter 46 a tubular inner adapter 56 is arranged which can also be driven in a rotating manner by the output shaft 14. In the illustrated embodiment the outer adapter 46 comprises for this purpose a drive toothing 48 which is engaged with a corresponding drive toothing 58 of the inner adapter 56. The toothing between outer adapter 46 and inner adapter 56 can be designed as a spline profile.

For the spring-mounted support of the inner adapter 56 in the outer adapter 46 a spring means 43 is provided. This comprises two counteracting spring elements 44, which are arranged on both axial sides of the drive toothing 48, 58.

The spring elements 44 are each supported on the one hand by the inner adapter 56 and on the other hand by a stop 47 of the outer adapter 46. The space, in which the springs 44 and the drive toothings 48, 58 are arranged, is sealed off against the surrounding area by means of sealing elements 45. The inner adapter 56 can also be supported in a floating manner between the springs 44. Various types of spring elements are conceivable.

At its end facing towards the borehole bottom the outer rod 62 is provided with a ring-shaped drilling tool 68. At its end facing away from the drive means 12 the inner rod 64 is equipped with a percussion drive 70. The percussion drive 70 is fixed on the inner rod 64 and comprises a percussive body 72 that is supported in an axially movable manner in a sleeve-shaped guide piece 74 in order to apply a percussive movement to a drilling tool 78 of the inner rod 64. By preference, the percussion drive 70 is operated hydraulically and can, in particular, be a pneumatic deep-hole hammer that applies an impact onto the drill bit of the inner rod. In the case of a pneumatic percussion drive or deep-hole hammer the compressed air can be utilized for the spring-mounted support of the inner adapter 56. In this way, the springs 44 could be dispensed with.

In the following the operation of a drive device according to the invention is described:

The vibration unit or the vibration drive 30 is set into a movement oscillating axially with respect to the drilling axis 6 by bringing the shafts 34 with their eccentrics 36 into a synchronized rotational movement so that proportions of imbalance acting radially to the longitudinal axis offset each other. Since the output shaft 14 is connected via the bearing 38 to the vibration drive 30, it is also set into vibration.

By way of the pinion 24 the drive motor 22 drives the main shaft 26 of the rotary drive 20. The torque is transmitted via a drive toothing 16, 27 to the output shaft 14.

By way of the outer rod adapter 46, which can also be provided with ejection openings, the rotation and vibration are transmitted directly to the outer pipe 62 to be driven. Hence, the vibration is also transmitted to the drilling tool 68 or the drill bit of the outer pipe 62.

By way of a drive toothing 48 the torque is also transmitted from the outer rod adapter 46 to the adapter 56 for the inner rod 64.

Due to the fact that in the axial front and rear area the inner adapter 56 is supported by the springs 44 against the outer adapter 46, the vibrating movement is not transmitted or only to a reduced degree to the inner adapter 56 and thus to the inner rod 64.

By means of the percussion drive 70 arranged at the rod end a percussive impact can be applied to the drilling tool 78 of the inner rod 64.

The drive device 10 according to the invention renders it possible to transmit a rotational movement of a drive means in a cost-efficient and simple manner to both an outer rod and an inner rod. By way of an adapter means the inner rod is decoupled axially such that a vibrating movement generated by the drive means 12 is transmitted fully to the outer rod but not, or only to a reduced degree, to the inner rod. For this purpose, the inner rod is accommodated in an axially displaceable manner in the outer rod. To generate a percussive movement of the inner rod a percussion drive is provided at the tool-facing end of the inner rod. With the drive device overburden drilling can be carried out for example.

The invention claimed is:

1. Drive device for driving a drill rod, the drive device comprising:

a drive means with a rotary drive and a vibration drive for driving an output shaft in a rotating and axially vibrating manner; and an adapter means which is coupled with the output shaft and comprises an outer adapter for connecting an outer rod and an inner adapter for connecting an inner rod, wherein the outer adapter is adapted to transmit the rotational movement and the axially vibrating movement of the output shaft to the outer rod, the inner adapter is supported in an axially displaceable and spring-mounted manner in the outer adapter, the output shaft and the adapter means are interposed between the drive means including the rotary drive and the vibration drive, and the outer rod and the inner rod, the output shaft is coupled via an axial bearing with the vibration drive and via a first drive toothing with the rotary drive, the output shaft is interposed between the drive means and the adapter means for transmission of rotational movement and axially vibrating movement to the adapter means, the outer adapter is firmly connected to the output shaft to transmit rotational movement and vibrating movement to the outer rod, and the inner adapter is displaceable with respect to the output shaft and spring-mounted to transmit the rotational movement to the inner rod while cushioning the vibrating movement to the inner rod.

2. Drive device according to claim 1, wherein the inner adapter is coupled via a second drive toothing with the outer adapter in order to transmit the rotational movement of the outer adapter to the inner adapter.

3. Drive device according to claim 1, wherein for the spring-mounted support of the inner adapter in the outer adapter a spring means having at least one spring element is provided, which is designed as a preload spring and/or as a pneumatic spring unit.

4. Drive device according to claim 1,
wherein
the spring means has at least two mutually counteracting spring elements.

5. Drive device according to claim 1,
wherein
the vibration drive comprises rotating masses.

6. Drive device according to claim 1,
wherein
the rotary drive comprises a drive shaft which can be driven in a rotating manner and is coupled via the first drive toothing with the output shaft.

7. Drive device according to claim 1,
wherein
the rotary drive and the vibration drive are accommodated in a common housing.

8. Drive device according to claim 1,
wherein
the rotary drive is arranged on the side of the vibration drive facing towards the adapter means.

9. Drive device according to claim 1,
wherein
the adapter means comprises a flange and/or a thread for coupling with the output shaft.

10. Drive device according to claim 1,
wherein
at its end lying opposite the adapter means the inner rod is coupled with a percussion drive for generating a percussive movement of a drilling tool.

11. Drive device according to claim 1,
wherein
on the outer rod a ring-shaped drilling tool is fixed.

12. Method for operating a drive device, wherein
a rotating and axially vibrating movement is transmitted by means of a drive means to an output shaft,
the rotating and axially vibrating movement of the output shaft is transmitted to an outer adapter which is coupled with an outer rod,
the rotational movement of the outer adapter and/or the output shaft is transmitted to an inner adapter which is coupled with an inner rod,
the inner adapter is supported in an axially displaceable and spring-mounted manner in the outer adapter,
the output shaft, the inner adapter and the outer adapter are interposed between the drive means and the outer rod and the inner rod,
the output shaft is coupled via an axial bearing with the vibration drive and via a first drive toothing with the drive means,
the output shaft is interposed between the drive means and the adapter means for transmission of rotational movement and axially vibrating movement to the adapter means,
the outer adapter is firmly connected to the output shaft to transmit rotational movement and vibrating movement to the outer rod, and
the inner adapter is displaceable with respect to the output shaft and spring-mounted to transmit the rotational movement to the inner rod while cushioning the vibrating movement to the inner rod.

13. Method according to claim 12,
wherein
the rotational movement of the outer adapter is transmitted via a second drive toothing to the inner adapter.

* * * * *